US010791906B2

(12) United States Patent
Feddema et al.

(10) Patent No.: US 10,791,906 B2
(45) Date of Patent: Oct. 6, 2020

(54) DISHWASHER WITH ADJUSTABLE DISH RACK TINES

(71) Applicant: Whirlpool Corporation, Benton Harbor, MI (US)

(72) Inventors: Mark S. Feddema, Kalamazoo, MI (US); Joseph T. Ferencevich, Saint Joseph, MI (US); Venkat Vadlamani, Memphis, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 156 days.

(21) Appl. No.: 16/026,321

(22) Filed: Jul. 3, 2018

(65) Prior Publication Data

US 2020/0008648 A1 Jan. 9, 2020

(51) Int. Cl.
*A47L 15/50* (2006.01)

(52) U.S. Cl.
CPC ..... *A47L 15/504* (2013.01)

(58) Field of Classification Search
None
See application file for complete search history.

(56) References Cited

U.S. PATENT DOCUMENTS 6,848,585 B2 * 2/2005 VanLandingham ... A47L 15/504 211/41.8
8,104,628 B2 * 1/2012 Kim ..... A47L 15/503 211/171
2005/0109378 A1 * 5/2005 Landsiedel ..... A47L 15/14 134/135

FOREIGN PATENT DOCUMENTS

EP 2184002 B1 5/2012
KR 101210124 B1 12/2012
KR 401750314 B1 6/2017

OTHER PUBLICATIONS

Goemans Appliances, Samsung Dishwasher Flexible Rack System, https://www.youtube.com/watch?v=eF3m14p6U1Y, Published Jan. 8, 2015, accessed Jul. 2, 2018.

* cited by examiner

*Primary Examiner* — Michael E Barr
*Assistant Examiner* — Jason P Riggleman
(74) *Attorney, Agent, or Firm* — McGarry Bair PC

(57) ABSTRACT

A dishwasher includes a tub at least partially defining a treating chamber. At least one dish rack defines an interior and is located in the treating chamber. At least one set of tines is located within the interior of the dish rack. A tine angle adjustment assembly includes an adjuster plate movably coupled to the at least one dish rack. The adjuster plate includes at least one adjuster pin. An adjusting arm operably couples the set of tines to the at least one adjuster pin.

22 Claims, 10 Drawing Sheets

DISHWASHER WITH ADJUSTABLE DISH RACK TINES

BACKGROUND

Contemporary automatic dishwashers for use in a typical household include a tub that can have an open front and at least partially defines a treating chamber into which items, such as kitchenware, glassware, and the like, can be placed to undergo a washing operation. At least one rack or basket for supporting soiled dishes can be provided within the tub. A spraying system with multiple sprayers can be provided for recirculating liquid throughout the tub to remove soils from the dishes. The dishwasher can be provided with a door, which can be pivotally mounted to the tub that closes the open front. The at least one rack or basket can be provided in the form of upper and lower dish racks.

In order to provide more flexibility to users, tines or rows of tines can be included with at least one of the dish racks to provide support for various items loaded into the dishwasher. The angle of the tines relative to the dish rack can be adjustable to allow a user the flexibility to select the desired tine angle to accommodate the particular items to be washed during a particular cycle of the dishwasher. Typically, such tine angle adjustment methods include the user bending the tine and repositioning the tine in a different location. Such methods increase the likelihood that a tine could be bent or stressed, as well as calling for an undesirable amount of force to be exerted by the user. If sufficient force is not applied, the tine can remain loose and not be firmly held in position, resulting in a lack of support for the dish items to be washed.

BRIEF SUMMARY

In one aspect, illustrative embodiments in accordance with the present disclosure relate to a dishwasher including a tub at least partially defining a treating chamber, at least one dish rack defining an interior and located in the treating chamber, at least one set of tines located within the interior of the dish rack, and a tine angle adjustment assembly, including an adjuster plate movably coupled to the at least one dish rack for movement relative to the dish rack, the adjuster plate including at least one adjuster pin, and an adjusting arm operably coupling the set of tines to the at least one adjuster pin, wherein a position of the adjuster pin engaging the adjusting arm rotationally locates the adjusting arm to determine a rotational position of the set of tines.

In another aspect, illustrative embodiments in accordance with the present disclosure relate to a dishwasher including a tub at least partially defining a treating chamber, at least one dish rack defining an interior and located in the treating chamber, at least one set of tines located within the interior of the dish rack, and a tine angle adjustment assembly, including an adjuster plate movably coupled to the at least one dish rack for upward and downward movement relative to the dish rack, the adjuster plate including at least one adjuster pin, and an adjusting arm operably coupling the set of tines to the at least one adjuster pin, wherein a position of the adjuster pin engaging the adjusting arm rotationally locates the adjusting arm to determine a rotational position of the set of tines.

DETAILED DESCRIPTION OF EMBODIMENTS OF THE INVENTION

Figure 1:
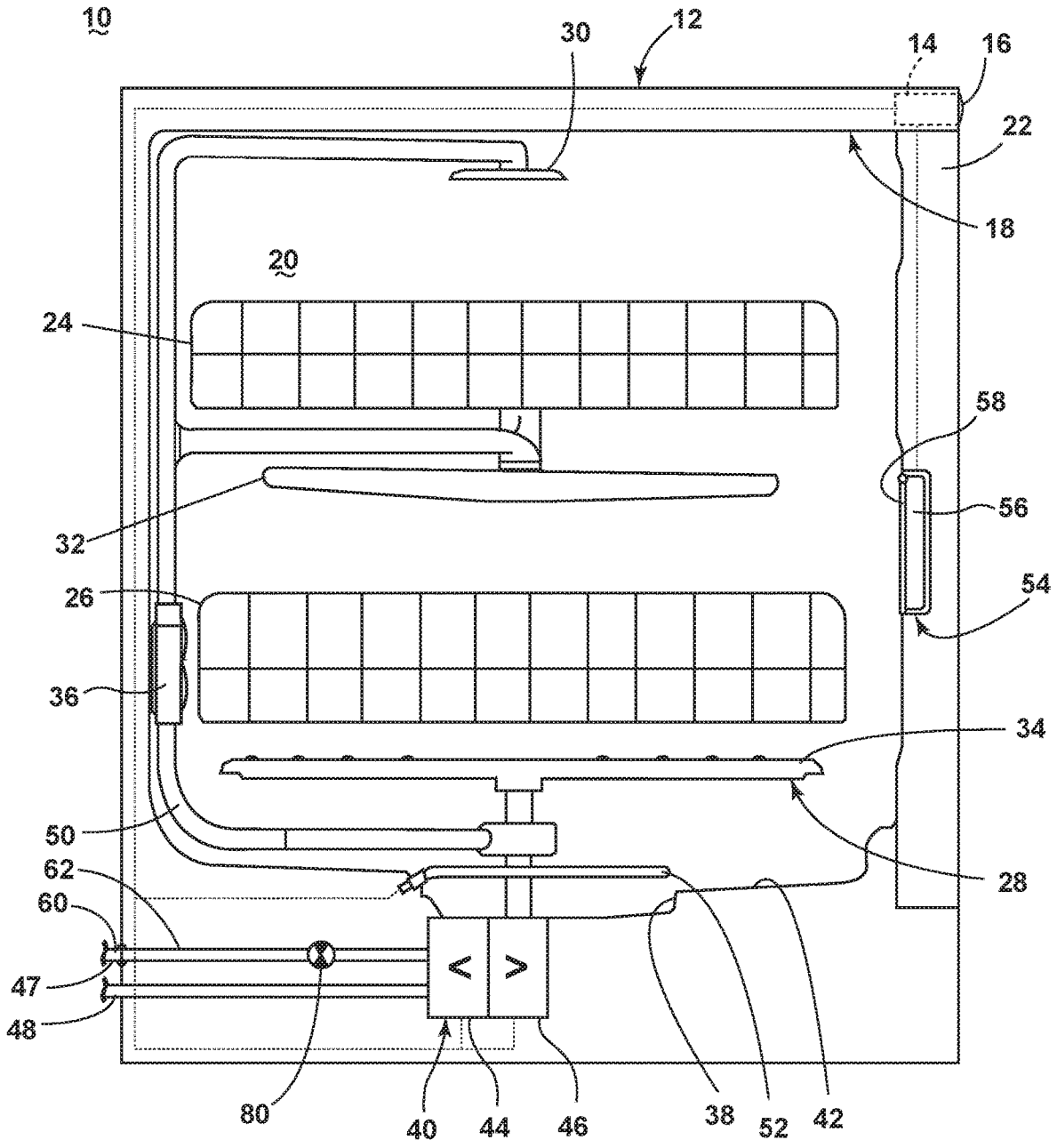
FIG. 1 illustrates a schematic, side view of a dishwasher according to an embodiment of the present disclosure.

FIG. 1 is a schematic, side view of a dishwasher 10 for treating dishes according to an automatic cycle of operation, according to an embodiment of the present disclosure. In FIG. 1, the dishwasher 10 includes a chassis 12 defining an interior. Depending on whether the dishwasher 10 is a stand-alone or built-in dishwasher, the chassis 12 can be a frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it can also be implemented in other types of dishwashing units, such as in-sink dishwashers, multi-tub dishwashers, or drawer-type dishwashers.

A controller 14 can be located within the chassis 12 and can be operably coupled with various components of the dishwasher 10 to implement one or more cycles of operation. A control panel or user interface 16 can be provided on the dishwasher 10 and coupled with the controller 14. The user interface 16 can be provided on the chassis 12 or on the outer panel of the door 22 and can include operational controls such as dials, lights, switches, and displays enabling a user to input commands, such as a cycle of operation, to the controller 14 and receive information about the selected cycle of operation.

A tub 18 is located within the interior of and mounted to the chassis 12 and at least partially defines a treating chamber 20 with an access opening in the form of an open face. A cover, illustrated as a door 22, can be hingedly or pivotally mounted to the chassis 12 and can selectively move between an opened position, wherein the user can access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 define an interior and are mounted for slidable movement in and out of the treating chamber 20 for ease of loading and unloading. As used in this description, the term "dish(es)" is intended to be generic to any item, single or plural, that may be treated in the dishwasher 10, including, without limitation; dishes, plates, pots, bowls, pans, glassware, silverware, and other utensils. While not shown, additional dish holders, such as a silverware basket on the interior of the door 22 or a third level rack above the upper rack 24 can also be provided.

A spraying system 28 can be provided for spraying liquid into the treating chamber 20 and is illustrated in the form of an upper sprayer 30, a mid-level sprayer 32, a lower sprayer 34, and a spray manifold 36. The upper sprayer 30 can be located above the upper rack 24 and is illustrated as a fixed spray nozzle that sprays liquid downwardly within the treating chamber 20. Mid-level sprayer 32 and lower sprayer 34 are located beneath upper rack 24 and lower rack 26, respectively, and are illustrated as rotating spray arms. The mid-level sprayer 32 can provide a liquid spray upwardly through the bottom of the upper rack 24. The lower sprayer 34 can provide a liquid spray upwardly through the bottom of the lower rack 26. The mid-level sprayer 32 can optionally also provide a liquid spray downwardly onto the lower rack 26, but for purposes of simplification, this will not be illustrated herein.

The spray manifold 36 can be fixedly mounted to the tub 18 adjacent to the lower rack 26 and can provide a liquid spray laterally through a side of the lower rack 26. The spray manifold 36 is not limited to this position; rather, the spray manifold 36 can be located in any suitable part of the treating chamber 20. While not illustrated herein, the spray manifold 36 can include multiple spray nozzles having apertures configured to spray wash liquid towards the lower rack 26. The spray nozzles can be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety. Instead of or in addition to the spray manifold 36 provided on the rear wall, nozzles can be provided on the right and left side walls of the tub 18.

A liquid recirculation system can be provided for recirculating liquid from the treating chamber 20 to the spraying system 28. The recirculation system can include a sump 38 and a pump assembly 40. The sump 38 collects the liquid sprayed in the treating chamber 20 and can be formed by a sloped or recess portion of a bottom wall 42 of the tub 18. The pump assembly 40 can include both a drain pump 44 and a recirculation pump 46.

The liquid recirculation system can also be fluidly coupled with a water supply line 47 for receiving fresh water from a water supply source, such as a household water supply, as well as a water supply circuit. The water supply circuit comprises a household inlet fitting 60, which is carried by the chassis 12, a conduit 62 that fluidly couples the inlet fitting 60 to the tub 18, and an actuatable valve 80. The actuatable valve 80 selectively controls the flow of liquid through the conduit 62, allowing the flow of liquid from the conduit 62 into the tub 18 when the actuatable valve 80 is in an opened position, and preventing the flow of liquid from the conduit 62 into the tub 18 when the actuatable valve 80 is in a closed position.

The drain pump 44 can draw liquid from the sump 38 and pump the liquid out of the dishwasher 10 to a household drain line 48. The recirculation pump 46 can draw liquid from the sump 38 and pump the liquid through the spray system 28 to supply liquid into the treating chamber 20 through a supply tube 50 to one or more of the sprayers 30, 32, 34, 36. In this manner, liquid can circulate from the sump 38 through the liquid recirculation system to the spray system 28 and back to the sump 38 to define a liquid recirculation circuit or flow path.

While the pump assembly 40 is illustrated as having separate drain and recirculation pumps 44, 46 in an alternative embodiment, the pump assembly 40 can include a single pump configured to selectively supply wash liquid to either the spraying system 28 or the drain line 48, such as by configuring the pump to rotate in opposite directions, or by providing a suitable valve system.

A heating system having a heater 52 can be located within or near the sump 38 for heating liquid contained in the sump 38. The heater 52 can also heat air contained in the treating chamber 20. Alternatively, a separate heating element (not shown) can be provided for heating the air circulated through the treating chamber 20. A filtering system (not shown) can be fluidly coupled with the recirculation flow path for filtering the recirculated liquid.

A user-accessible dispensing system can be provided for storing and dispensing one or more treating chemistries to the treating chamber 20. As shown herein, the user-accessible dispensing system can include a dispenser 54 mounted on an inside surface of the door 22 such that the dispenser 54 is disposed in the treating chamber 20 when the door 22 is in the closed position. The dispenser 54 is configured to dispense treating chemistry to the dishes within the treating chamber 20. The dispenser 54 can have one or more compartments 56 closed by a door 58 on the inner surface of the door 22. The dispenser 54 can be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser.

The dispenser 54 can further be configured to hold multiple different treating chemistries. For example, the dispenser 54 can have multiple compartments defining different chambers in which treating chemistries can be held. While shown as being disposed on the door 22, other locations of the dispenser 54 are possible. However, the dispenser 54 is positioned to be accessed by the user for refilling of the dispenser 54, whether it is necessary to refill the dispenser 54 before each cycle (i.e. for a single user dispenser) or only periodically (i.e. for a bulk dispenser).

Figure 2:
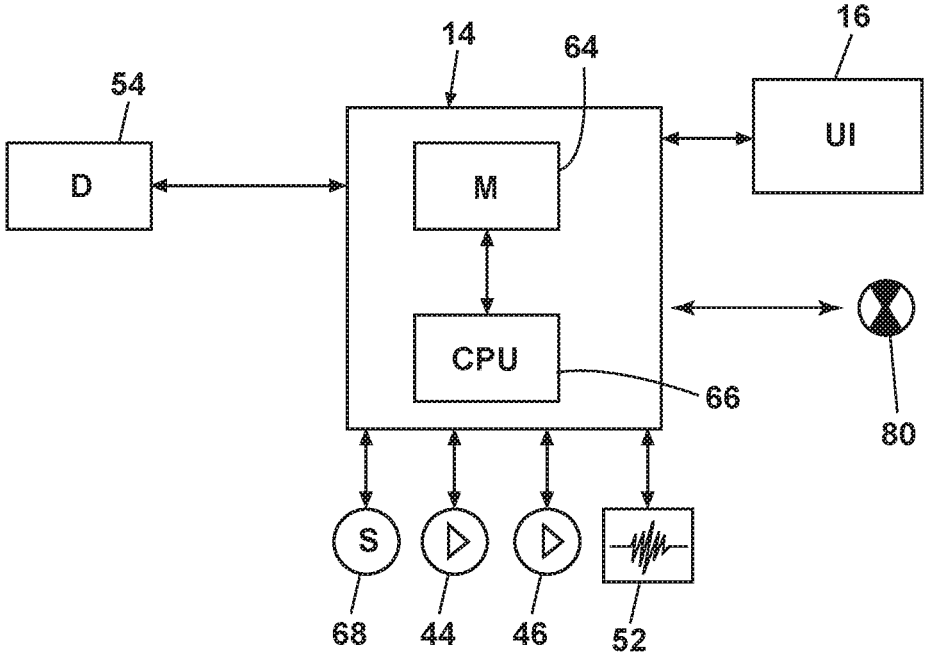
FIG. 2 illustrates a schematic view of a controller for use with the dishwasher of FIG. 1.

FIG. 2 is a schematic view of the controller 14 of the dishwasher 10 of FIG. 1. As illustrated schematically in FIG. 2, the controller 14 can be coupled with the heater 52 for heating the wash liquid during a cycle of operation, the drain pump 44 for draining liquid from the treating chamber 20, the recirculation pump 46 for recirculating the wash liquid during the cycle of operation, the user-accessible dispenser 54 for selectively dispensing treating chemistry to the treating chamber 20, and the actuatable valve 80 to selectively control the flow of liquid through the conduit 62 into the tub 18.

The controller 14 can be provided with a memory 64 and a central processing unit (CPU) 66. The memory 64 can be used for storing control software that can be executed by the CPU 66 in completing a cycle of operation using the dishwasher 10 and any additional software. For example, the memory 64 can store one or more pre-programmed cycles of operation that can be selected by a user and completed by the dishwasher 10. A cycle of operation for the dishwasher 10 can include one or more of the following steps: a wash step, a rinse step, and a drying step. The wash step can further include a pre-wash step and a main wash step. The rinse step can also include multiple steps such as one or more additional rinsing steps performed in addition to a first rinsing. The amounts of water and/or rinse aid used during each of the multiple rinse steps can be varied. The drying step can have a non-heated drying step (so called "air only"), a heated drying step or a combination thereof. These multiple steps can also be performed by the dishwasher 10 in any desired combination.

The controller 14 can also receive input from one or more sensors 68. Non-limiting examples of sensors 68 that can be communicably coupled with the controller 14 include a temperature sensor and turbidity sensor to determine the soil load associated with a selected grouping of dishes, such as the dishes associated with a particular area of the treating chamber 20.

Figure 3:
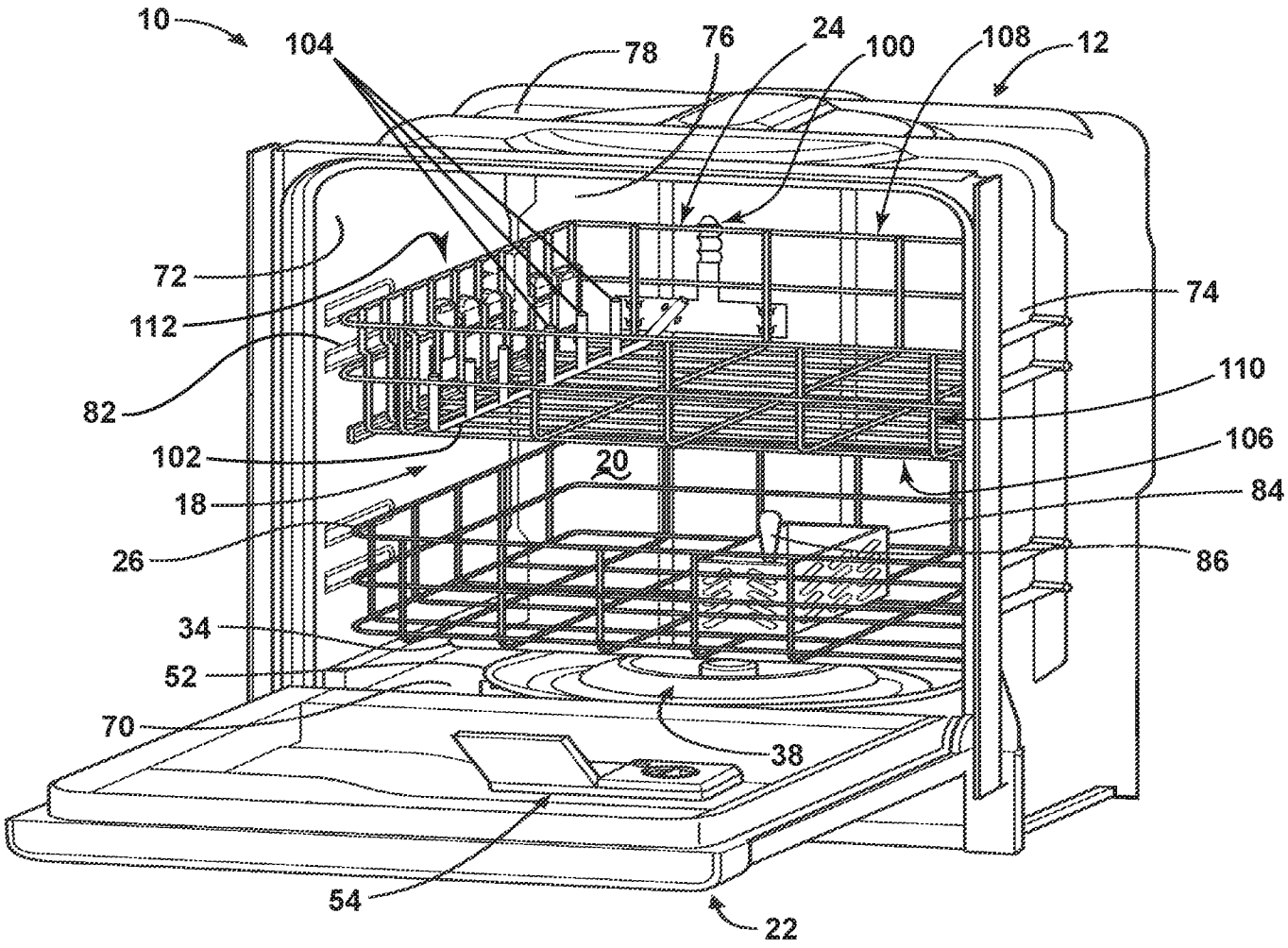
FIG. 3 illustrates a perspective view of the dishwasher of FIG. 1 including a dish rack having a tine angle adjustment assembly in accordance with an embodiment of the present disclosure.

Turning now to FIG. 3, a perspective view of the dishwasher 10 is illustrated. The tub 18, which, by way of non-limiting example, can be injection molded of plastic, can include a bottom wall 70, side walls 72, 74, rear wall 76, and a top wall 78. The upper rack 24 can be coupled to the side walls 72, 74 for slidable movement relative thereto via support rails 82. A utensil basket 84, which contains a utensil 86, can be positioned within the lower rack 26, or at any other suitable location within the dishwasher 10. At least one tine assembly 102 can be provided within the upper rack 24 or the lower rack 26, or both. Any suitable number of tine assemblies 102 can be provided, including, by way of non-limiting example, multiple tine assemblies 102 in each of the upper rack 24 and the lower rack 26. The tine assembly 102 can be provided as a row or a set of generally vertically oriented, laterally-spaced tines 104 coupled to one another, such as by an elongated element. The tine assembly 102 can extend fully across a dimension of the upper rack 24, as illustrated in FIG. 3, or, the tine assembly 102 can extend only partially across a dimension of the upper rack 24, such as being split into a front portion and a back portion tine assembly 102. The tine assembly 102 can be rotatably or pivotably coupled to the upper rack 24.

The upper and/or lower racks 24, 26 as well as the tine assembly 102, can be made from coated wire. The upper and/or lower racks 24, 26 can form a wire frame structure, along with the tine assembly 102. It will be understood that the dishwasher 10 can also include a combination of fixed and rotatably adjustable tines 104, or that all of the tines 104 within the dishwasher 10 can be rotatably adjustable. Where the rotatable tine assembly 102 is provided, the tine assembly 102 can be coupled to the upper rack 24 in such a way that the entire tine assembly 102 is rotatably or pivotally mounted to the upper rack 24. Alternately, the tine assembly 102 can be fixedly coupled to or integrally formed with the upper rack 24 such that only the tines 104 themselves are rotatable or pivotable relative to the upper rack 24.

A tine angle adjustment assembly 100 can be coupled with the tine assembly 102 to provide control of the rotational position of the tine assembly 102 relative to the upper rack 24. While the tine angle adjustment assembly 100 is illustrated herein as being coupled with a rear wall 108 of the upper rack 24, it will be understood that other locations for the tine angle adjustment assembly 100 are also contemplated. For example, the tine angle adjustment assembly 100 can be coupled with a front wall 110 of the upper rack 24. In the case that the tine assembly 102 does not extend all the way from the front wall 110 to the rear wall 108, but rather covers, for example, a front half or a rear half of the upper rack 24, the tine angle adjustment assembly 100 can be provided on both a front wall 110 and a rear wall 108 to control the respective halves of the tine assembly 102. In addition, the tine assembly 102 can extend from side-to-side between side walls 112 of the upper rack 24, rather than between the front wall 110 and the rear wall 108. In this case, the tine angle adjustment assembly 100 can be provided on the side wall 112. It is also contemplated that more than one tine angle adjustment assembly 100 can be provided to couple with a single tine assembly 102, such that one tine angle adjustment assembly 100 couples with each end of the tine assembly 102.

Figure 4:
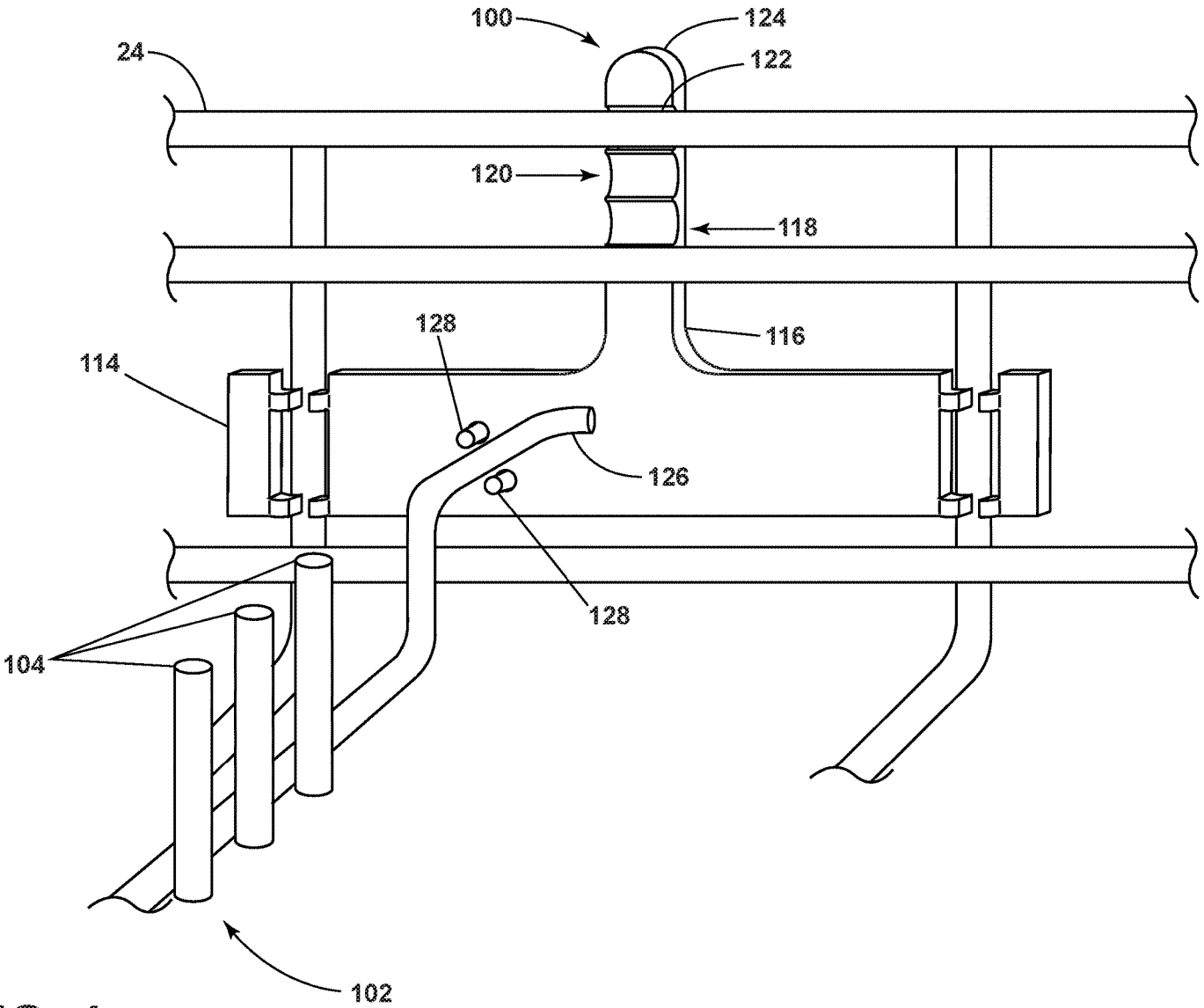
FIG. 4 illustrates a perspective view of the tine angle adjustment assembly of FIG. 3 according to an embodiment of the present disclosure.

FIG. 4 illustrates a perspective view of the tine angle adjustment assembly 100 according to an embodiment of the present disclosure. The tine angle adjustment assembly 100 comprises an adjuster plate 114 that couples to the upper rack 24, as well as a locking lever 116 that extends upwardly from the adjuster plate 114 along the rear wall 108 of the upper rack 24. The adjuster plate 114 can be movably coupled to the upper rack 24 for upward and downward movement relative to the upper rack 24. Specifically, the adjuster plate 114 can be upwardly and downwardly slidable along the upper rack 24, and, by way of non-limiting example, slidable along the rear wall 108 of the upper rack 24. While the adjuster plate 114 is illustrated herein as being movably coupled to the upper rack 24 for upward and downward movement relative to the upper rack 24, it will be understood that the adjuster plate 114 can be moveably coupled to the upper rack 24 for side-to-side or lateral movement relative to the upper rack 24.

The locking lever 116 can be provided with at least one locking detent, illustrated herein as a first locking detent 122, a second locking detent 120, and a third locking detent 118. While the locking lever 116 is illustrated herein as being provided with three locking detents 118, 120, 122, it will be understood that any suitable number of locking detents can be provided such that each locking detent 118, 120, 122 defines a plurality of discrete positions of the adjuster plate 114 relative to the upper rack 24. The locking detents 118, 120, 122 can selectively couple with the upper rack 24 in order to prevent vertical movement of the adjuster plate 114 relative to the upper rack 24. An adjustment flange 124 can be provided with the locking lever 116 to allow for the locking lever 116 to be disengaged from the upper rack 24 and vertically adjusted to one of the locking detents 118, 120, 122.

The adjuster plate 114 can further comprise at least one adjuster pin 128. While the adjuster plate 114 is illustrated herein as having two adjuster pins 128 spaced from one another, it will be understood that a single adjuster pin 128, or more than two adjuster pins 128 can also be provided. The adjuster pins 128 can be arranged, by way of non-limiting example, in a line or an arc. The tine assembly 102 can include an adjusting arm 126. The adjusting arm 126 can be received between the adjuster pins 128 to operably couple the tine assembly 102 to the adjuster pins 128 such that a vertical position of the adjuster pins 128 engaging the adjusting arm 126 rotationally locates the adjusting arm 126 to determine a rotational position of the tine assembly 102.

Figure 5:
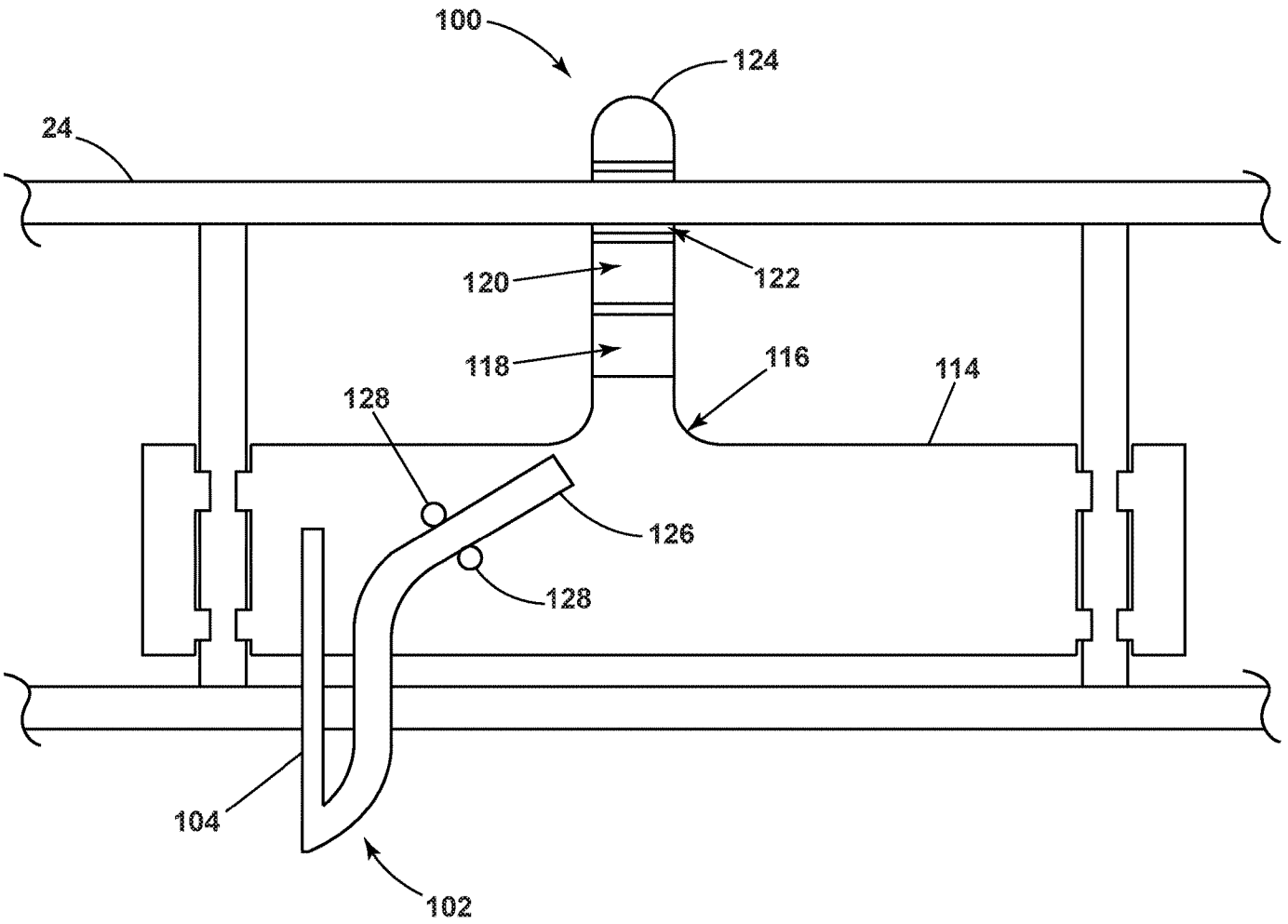
FIG. 5 illustrates a front view of the tine angle adjustment assembly of FIG. 4 in a first position.

FIG. 5 illustrates a front view of the tine angle adjustment assembly 100 of FIG. 4 in a first position. In the first position, the adjuster plate 114 occupies a lowermost position relative to the upper rack 24, such that the first locking detent 122 is coupled with the upper rack 24. The angle at which the adjusting arm 126 is received between the adjuster pins 128 in the first position results in a rotational position of the tine assembly 102 such that the tines 104 are positioned in a generally vertical orientation. Further, the adjusting arm 126 couples the tine assembly 102 with the adjuster pins 128 such that upward and downward movement of the adjuster plate 114, and thus upward and downward movement of the adjuster pins 128, results in a rotation of the adjusting arm 126 and of the tines 104 to adjust the rotational position of the tines 104 or tine assembly 102.

Figure 6:
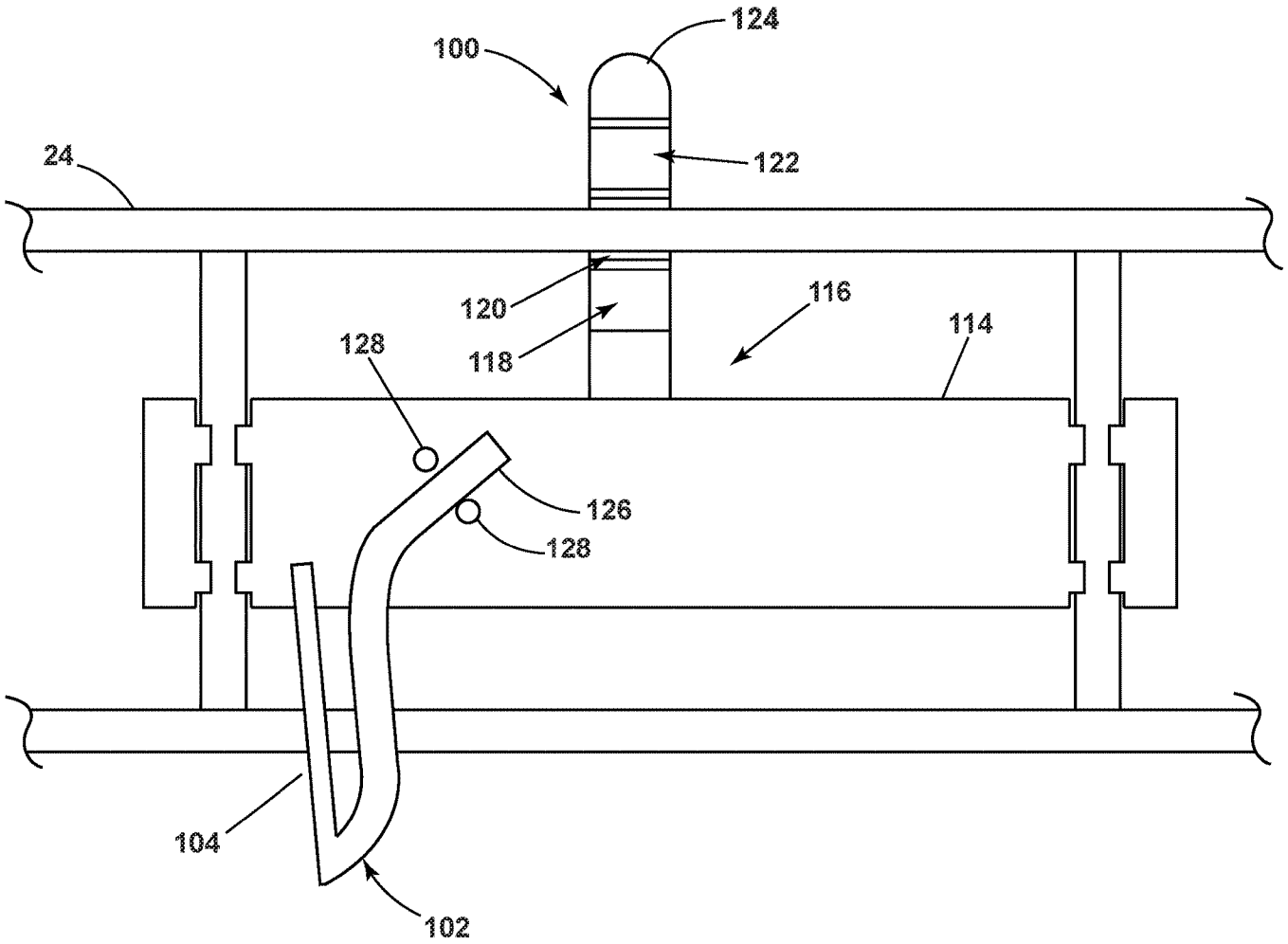
FIG. 6 illustrates a front view of the tine angle adjustment assembly of FIG. 4 in a second position.

FIG. 6 illustrates a front view of the tine angle adjustment assembly 100 of FIG. 4 in a second position. In the second position, the adjuster plate 114 occupies a raised position relative to the upper rack 24 and relative to the first position, such that the second locking detent 120 is coupled with the upper rack 24. As the vertical position of the adjuster plate 114 is higher relative to the upper rack 24 in the second position than in the first position, the raised position of the adjuster pins 128 in the second position cause the tine assembly 102 to be rotated such that the tines 104 are positioned at an angle to a vertical orientation.

Figure 7:
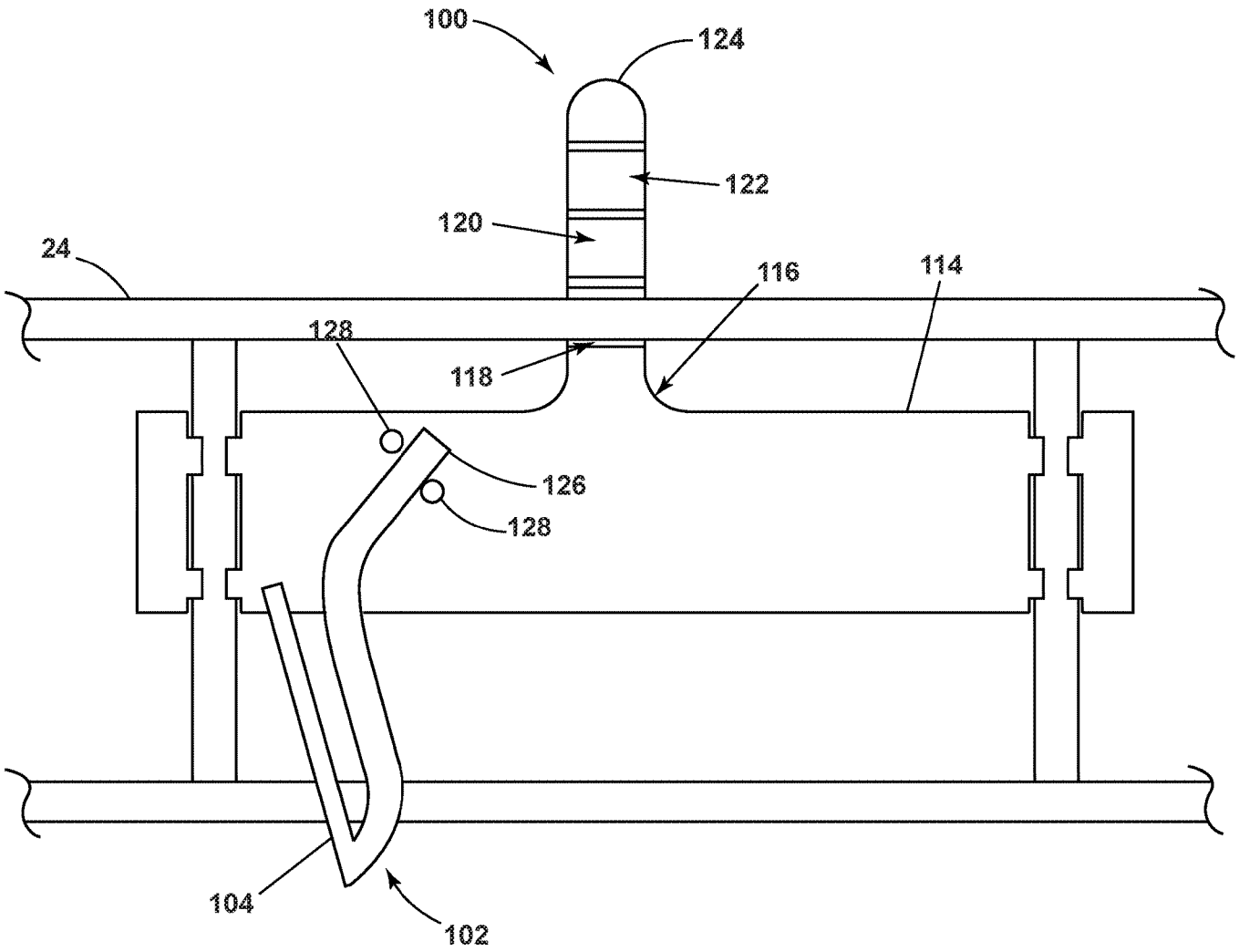
FIG. 7 illustrates a front view of the tine angle adjustment assembly of FIG. 4 in a third position.

FIG. 7 illustrates a front view of the tine angle adjustment assembly 100 of FIG. 4 in a third position. In the third position, the adjuster plate 114 occupies an uppermost position relative to the upper rack 24 and relative to the first and second positions, such that the third locking detent 118 is coupled with the upper rack 24. As the vertical position of the adjuster plate 114 is higher relative to the upper rack 24 in the third position than in either of the first or second positions, the raised position of the adjuster pins 128 in the third position causes the adjusting arm 126 to be rotated, causing the tine assembly 102 also to be further rotated such that the tines 104 are positioned at a greater angle to a vertical orientation than in the second position.

Turning now to the operation of the tine angle adjustment assembly 100, a user can apply an outward pressure to the adjustment flange 124 of the locking lever 116 in order to cause the locking lever 116 to disengage from the upper rack 24. With the locking lever 216 disengaged from the upper rack 24, the adjuster plate 114 can be raised or lowered relative to the upper rack 24. As the adjuster plate 114 and locking lever 116 are raised or lowered relative to the upper rack 24, the adjuster pins 128 bear against and apply either an upward or a downward pressure to the adjusting arm 126. The biasing of the adjuster pins 128 against the adjusting arm 126 cause the adjusting arm 126 to drive rotation of the tine assembly 102, adjusting the angle of the tines 104 relative the upper rack 24, and in particular relative to a bottom wall or surface 106 of the upper rack 24. In this way, the upward and downward movement of the adjuster plate 114 relative to the upper rack 24 changes the vertical position of the adjuster pins 128 to correspondingly rotate the tine assembly 102, in particular to a different rotational position altering an angle between the tine assembly 102 and the bottom surface 106. The adjuster pins 128 also serve to limit undesired rotation of the tine assembly 102 when the adjuster plate 114 is locked into place relative to the upper rack 24.

The number of locking detents 118, 120, 122 provided on the locking lever 116 can determine the number of potential tine assembly 102 angles that can be provided by the tine angle adjustment assembly 100. While the tine angle adjustment assembly 100 is illustrated herein as having discrete locking detents 118, 120, 122 to determine the rotational position of the tine assembly 102, it will also be understood that other mechanisms for coupling the adjuster plate 114 to the upper rack 24 can be provided. By way of non-limiting example, an attachment mechanism could be provided that allows for continuous vertical adjustment of the adjuster plate 114 relative to the upper rack 24 so that a larger variety of tine assembly 102 angles can be achieved.

Figure 8:
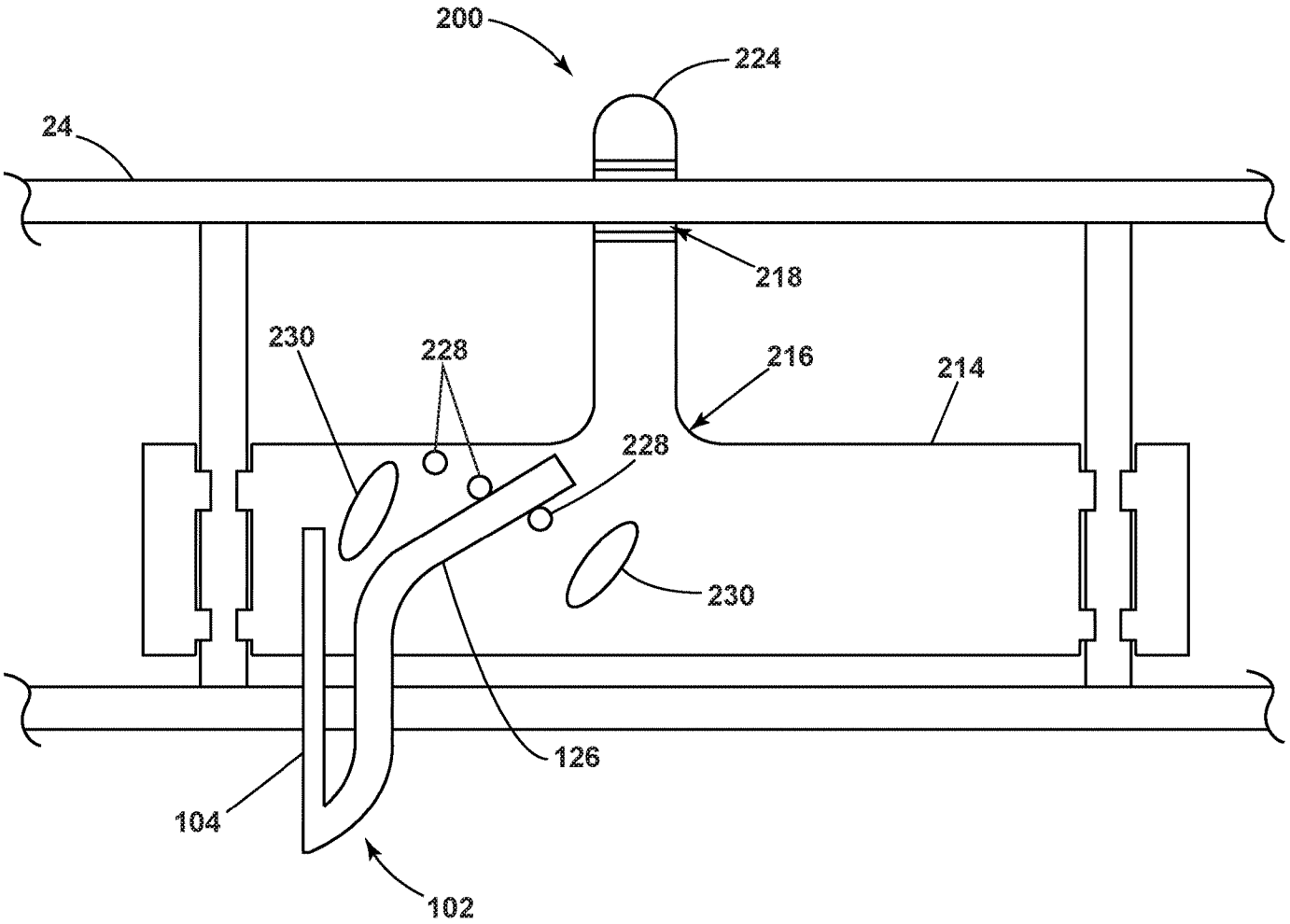
FIG. 8 illustrates a front view of the tine angle adjustment assembly of FIG. 3 according to another embodiment of the present disclosure in an engaged position with a tine assembly in a first position.

FIG. 8 illustrates a front view of a tine angle adjustment assembly 200 according to another embodiment of the present disclosure. In this embodiment, the structure and function of the tine assembly 102, tines 104, and the adjusting arm 126 remain the same as in the tine angle adjustment assembly 100. The adjuster plate 214 is configured to couple to the upper rack 24 and includes a locking lever 216, which can still include at least one locking detent 218 for selective engagement with the upper rack 24 to prevent vertical movement of the adjuster plate 214 relative to the upper rack 24. The adjustment flange 224 can be provided with the locking lever 216 to allow for the locking lever 216 to be disengaged from the upper rack 24 for vertical adjusting of the adjuster plate 214.

As shown in FIG. 8, the tine angle adjustment assembly 200 is in an engaged position with the tine assembly 102, such that the adjusting arm 126 is received between adjuster pins 228 and rotational movement of the adjusting arm 126, and thus the tine assembly 102, is prevented by the adjuster pins 228. While the adjuster plate 214 is illustrated herein as having three adjuster pins 228, it will be understood that any suitable number of adjuster pins 228 can be provided to define any suitable number of rotational positions for the tine assembly 102. The adjuster pins 228 can be provided as an array of adjuster pins 228 spaced from one another, and can be arranged in, by way of non-limiting example, a line or an arc. At least one limiting pin 230 can be provided adjacent the adjuster pins 228. A limiting pin 230 can be provided at each end of the arrangement of adjuster pins 228. The limiting pins 230 can extend lower on the adjuster plate 214 than the adjuster pins 228. The adjusting arm 126 can be received between any of the adjuster pins 228 or limiting pins 230. Any suitable size or shape can be implemented for the limiting pins 230 such that even when the adjuster plate 214 is in an uppermost vertical position, the adjusting arm 126 is retained between the limiting pins 230 such that the limiting pins 230 limit the rotational movement of the adjusting arm 126 even when the adjuster plate 214 is in the uppermost position, and the adjusting arm 126 is prevented from becoming completely disengaged with the adjuster plate 214, even when the adjust arm 126 is disengaged from the adjuster pins 228 (FIG. 9).

Figure 9:
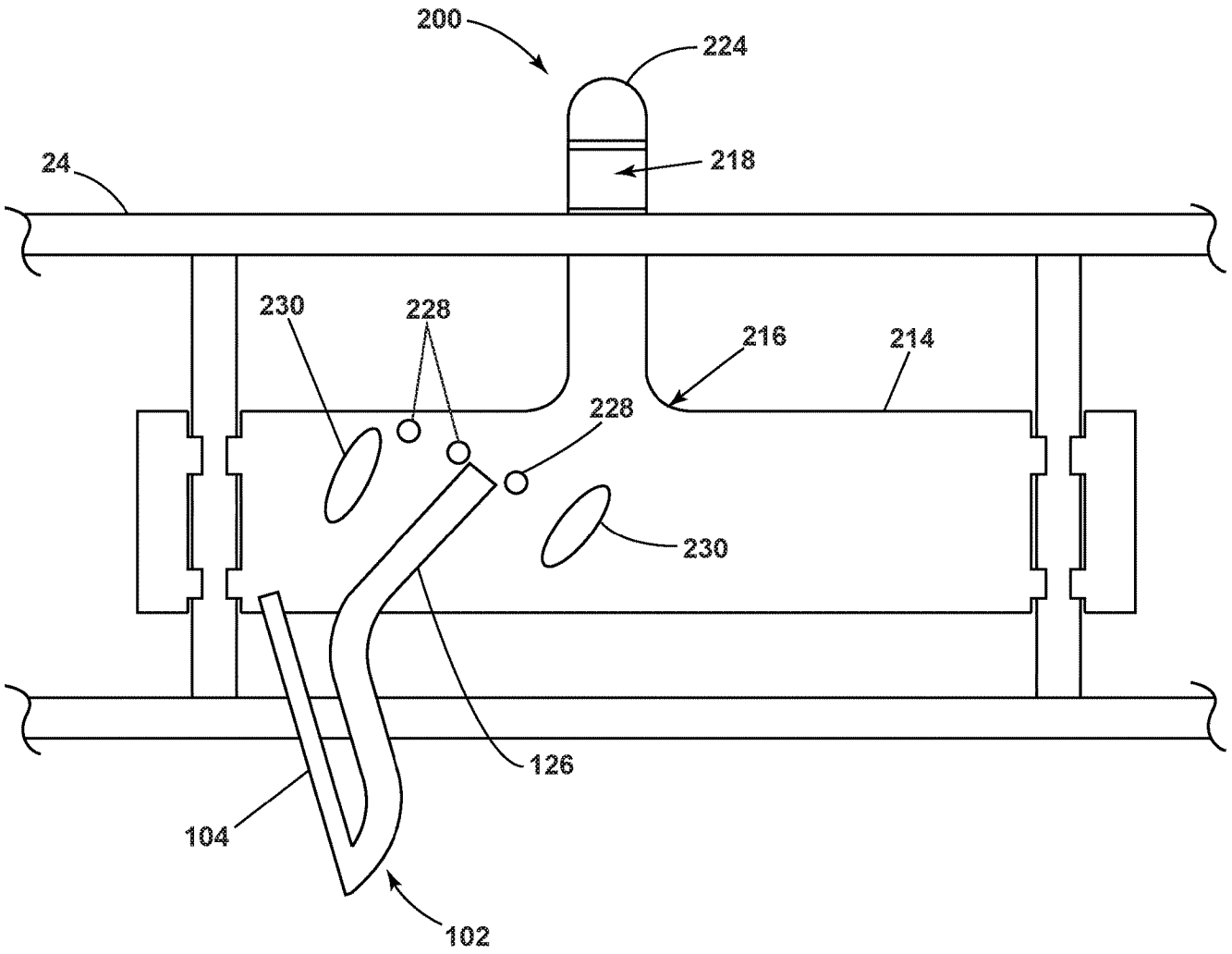
FIG. 9 illustrates a front view of the tine angle adjustment assembly of FIG. 8 in an uppermost disengaged position.

FIG. 9 illustrates a front view of the tine angle adjustment assembly 200 of FIG. 8 in an uppermost disengaged position. In the uppermost disengaged position, the locking lever 216 is disengaged from the upper rack 24 and the adjuster plate 214 occupies an uppermost position relative to the upper rack 24, such that the adjusting arm 126 is no longer received between the adjuster pins 228 and the adjuster pins 228 are above the adjusting arm 126. Although the adjusting arm 126 is not received between adjuster pins 228, it can still be received between the limiting pins 230, such that the limiting pins 230 are positioned vertically below an upper end of the adjusting arm 126 when the adjuster plate 214 is in the uppermost position. In this position, the adjusting arm 126 is free to be rotated to a different or new rotational position between the adjuster pins 228.

Figure 10:
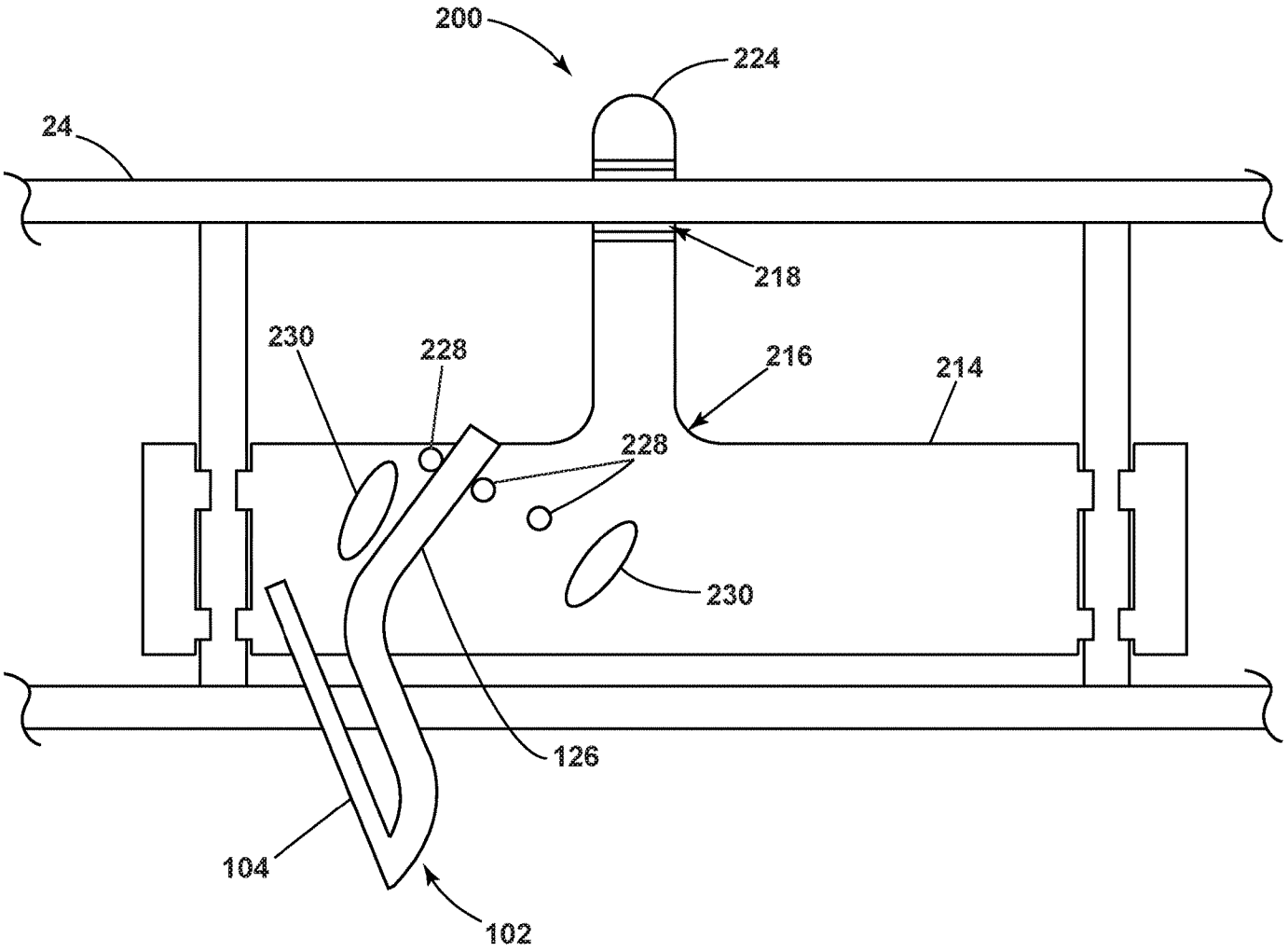
FIG. 10 illustrates a front view of the tine angle adjustment assembly of FIG. 8 returned to the engaged position with the tine assembly in a second position.

FIG. 10 illustrates a front view of the tine angle adjustment assembly 200 of FIG. 8 wherein the adjuster plate 214 is returned to the engaged position with the tine assembly 102, with the adjusting arm 126 now received between a different pair of adjuster pins 228 than shown in the view of FIG. 8, corresponding to the new rotational position.

Turning now to the operation of the tine angle adjustment assembly 200, with the tine assembly 102 in a starting position (FIG. 8), a user can apply an outward pressure to the adjustment flange 224 of the locking lever 216 in order to cause the locking lever 216 to disengage from the upper rack 24. With the locking lever 216 disengaged from the upper rack 24, the adjuster plate 214 can be raised relative to the upper rack 24. As the adjuster plate 214 and locking lever 216 are raised relative to the upper rack 24 from the engaged position to the disengaged position, the adjuster pins 228 are moved to a height above the adjusting arm 126, releasing the adjusting arm 126 from engagement with the adjuster pins 228 and allowing rotational movement of the adjusting arm 126 and the tine assembly 102. The limiting pins 230 prevent the adjusting arm 126 from becoming completely disengaged from the adjuster plate 214, instead allowing disengagement only with the adjuster pins 228. In the disengaged position (FIG. 9), a user can rotate the adjusting arm 126 until the tine assembly 102 and the tines 104 are provided in a desired position and at a desired angle relative to the upper rack 24, and in particular relative to the bottom surface 106 of the upper rack 24. When the adjusting arm 126 is in the user's desired position, the user can lower the adjuster plate 214 and the locking lever 216 down, back into the engaged position (FIG. 10), allowing the adjusting arm 126 to be received between a different pair of adjuster pins 228 than was occupied in the starting position (FIG. 8).

The number of adjuster pins 228 provided on the adjuster plate 214 can determine the number of potential tine assembly 102 angles that can be provided by the tine angle adjustment assembly 200. While the tine angle adjustment assembly 200 is illustrated herein as having one locking detent 118, any suitable number of locking detents 118 can be provided, including, for example, a second locking detent 118 positioned to hold the adjuster plate 214 in the uppermost disengaged position. It will also be understood that other mechanisms for coupling the adjuster plate 214 to the upper rack 24 can be provided. By way of non-limiting example, an attachment mechanism could be provided that allows for continuous vertical adjustment of the adjuster plate 214 relative to the upper rack 24 so that a larger variety of tine assembly 102 angles can be achieved.

The embodiments described herein can be used to provide an adjustment assembly for the angular or rotational position of tines or a row of tines to allow selective repositioning of the tines between at least a first and second rotational position in a user-friendly and simple manner, while maintaining stability of the tines by preventing undesired movement by way of the engagement between the adjusting arm and the adjuster pins. The adjustment assembly ensures that the tines do not need to be bent to be repositioned, reducing likelihood of stressing the tines and also reducing the force needed to reposition the tines. The tines are also held firmly in position without the opportunity for the tines being left loose and unable to support dish items due to instability. The embodiments described herein also require few additional parts and are low cost and easy for a user to understand and manipulate.

It will also be understood that various changes and/or modifications can be made without departing from the spirit of the present disclosure. By way of non-limiting example, although the present disclosure is described for use with a wire dish rack, it will be recognized that the tine angle adjustment assembly can be employed with various rack constructions, including molded racks, such as racks molded of plastic.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a treating chamber;

at least one dish rack defining an interior and located in the treating chamber;

at least one set of tines located within the interior of the dish rack; and a tine angle adjustment assembly comprising:

an adjuster plate movably coupled to the at least one dish rack for upward and downward movement relative to the dish rack, the adjuster plate including at least one adjuster pin; and an adjusting arm operably coupling the set of tines to the at least one adjuster pin, wherein a position of the adjuster pin engaging the adjusting arm rotationally locates the adjusting arm to determine a rotational position of the set of tines.

2. The dishwasher of claim 1 wherein the at least one adjuster pin comprises an array of multiple adjuster pins with a limiting pin provided at each end of the array.

3. The dishwasher of claim 1 wherein the at least one adjuster pin comprises at least two adjuster pins spaced from one another.

4. The dishwasher of claim 3 wherein the adjuster pins spaced from one another are arranged in a line or an arc.

5. The dishwasher of claim 3 wherein the adjusting arm is received between the two adjuster pins.

6. The dishwasher of claim 5 wherein the upward and downward movement of the adjuster plate relative to the dish rack changes a vertical position of the adjuster pins to correspondingly rotate the set of tines.

7. The dishwasher of claim 6 wherein the dish rack further defines a bottom wall.

8. The dishwasher of claim 7 wherein the upward and downward movement of the adjuster plate rotates the set of tines to a different rotational position altering an angle between the set of tines and the bottom wall of the dish rack.

9. The dishwasher of claim 1 wherein the adjuster plate includes a locking lever to selectively couple the adjuster plate to the dish rack.

10. The dishwasher of claim 9 wherein the locking lever defines at least one locking detent for coupling with the dish rack.

11. The dishwasher of claim 10 wherein the at least one locking detent defines a plurality of discrete positions of the adjuster plate relative to the dish rack.

12. The dishwasher of claim 1 wherein the at least one adjuster pin comprises an array of adjuster pins spaced from one another.

13. The dishwasher of claim 12 wherein the array of adjuster pins spaced from one another are arranged in a line or an arc.

14. The dishwasher of claim 12 wherein the adjusting arm is received between any of the array of adjuster pins.

15. The dishwasher of claim 14 wherein upward movement of the adjuster plate to an uppermost position raises the array of adjuster pins above the adjusting arm.

16. The dishwasher of claim 15 wherein the adjusting arm can be rotated to a new rotational position when the adjuster plate is raised to the uppermost position.

17. The dishwasher of claim 16 wherein lowering the adjuster plate from the uppermost position causes the adjusting arm to be received between different adjuster pins corresponding to the new rotational position.

18. The dishwasher of claim 17 wherein the adjuster plate further comprises at least one limiting pin.

19. The dishwasher of claim 18 wherein the at least one limiting pin is positioned vertically below an upper end of the adjusting arm when the adjuster plate is in the uppermost position.

20. The dishwasher of claim 19 wherein the at least one limiting pin limits a rotational movement of the adjusting arm when the adjuster plate is in the uppermost position.

21. The dishwasher of claim 1 wherein the set of tines is rotatable relative to the dish rack.

22. A dishwasher comprising:

a tub at least partially defining a treating chamber;

at least one dish rack defining an interior and located in the treating chamber;

at least one set of tines located within the interior of the dish rack; and a tine angle adjustment assembly comprising:

an adjuster plate movably coupled to the at least one dish rack for vertical movement relative to the dish rack, the adjuster plate including at least one adjuster pin; and an adjusting arm operably coupling the set of tines to the at least one adjuster pin, wherein a position of the adjuster pin engaging the adjusting arm rotationally locates the adjusting arm to determine a rotational position of the set of tines.

* * * * *